US008382458B2

(12) United States Patent
Hashida et al.

(10) Patent No.: US 8,382,458 B2
(45) Date of Patent: Feb. 26, 2013

(54) HIGH-PRESSURE FUEL PUMP

(75) Inventors: Minoru Hashida, Hitachinaka (JP); Hiroyuki Yamada, Hitachinaka (JP); Junichi Shimada, Tokyo (JP); Toru Onose, Ibaraki (JP); Satoshi Usui, Hitachinaka (JP); Masami Abe, Hitachi (JP); Tohru Himoto, Mito (JP)

(73) Assignee: Hitachi, Ltd., Tokyo (JP)

( * ) Notice: Subject to any disclaimer, the term of this patent is extended or adjusted under 35 U.S.C. 154(b) by 1144 days.

(21) Appl. No.: 11/780,940

(22) Filed: Jul. 20, 2007

(65) Prior Publication Data

US 2008/0019853 A1 Jan. 24, 2008

(30) Foreign Application Priority Data

Jul. 20, 2006 (JP) ..... 2006-197558

(51) Int. Cl.
*F04B 39/00* (2006.01)
*F04B 53/00* (2006.01)

(52) U.S. Cl. ..... 417/454; 417/269; 417/415

(58) Field of Classification Search ..... 417/490, 417/454, 439, 415, 296
See application file for complete search history.

(56) References Cited

U.S. PATENT DOCUMENTS

| | | | | |
|---|---|---|---|---|
| 7,114,928 | B2 | 10/2006 | Asayama et al. | |
| 2003/0017069 | A1* | 1/2003 | Usui et al. | 417/571 |
| 2003/0161746 | A1* | 8/2003 | Asayama et al. | 417/470 |
| 2004/0052652 | A1 | 3/2004 | Yamada et al. | |
| 2004/0109768 | A1* | 6/2004 | Sommars et al. | 417/307 |
| 2005/0019188 | A1* | 1/2005 | Usui et al. | 417/540 |

FOREIGN PATENT DOCUMENTS

| | | | |
|---|---|---|---|
| EP | 1 234 975 | A2 | 8/2002 |
| EP | 1 275 848 | A1 | 1/2003 |
| EP | 1 323 919 | A2 | 7/2003 |
| EP | 1 348 864 | A1 | 10/2003 |
| EP | 1 348 868 | A1 | 10/2003 |
| GB | 2 237 074 | A | 4/1991 |
| JP | 11-22493 | A | 1/1999 |
| JP | 2001-295770 | A | 10/2001 |
| JP | 2003-49743 | A | 2/2003 |
| WO | WO 02/055881 | A1 | 7/2002 |

OTHER PUBLICATIONS

European Search Report dated Apr. 1, 2009 (Seven (7) pages).

* cited by examiner

*Primary Examiner* — Peter J Bertheaud
(74) *Attorney, Agent, or Firm* — Crowell & Moring LLP

(57) ABSTRACT

A high-pressure fuel pump is comprises of: a plunger which slidably fits to a cylinder and reciprocates for pressurizing and discharging a fuel taken in a pressurizing chamber; an inlet valve device for taking in a fuel into the pressurizing chamber; an outlet valve device for discharging the pressurized fuel from the pressurizing chamber; and a communicating pass which comprises a hole or a groove formed in the cylinder, and communicates between a pressurized fuel area and a gap between the cylinder and the plunger.

18 Claims, 6 Drawing Sheets

HIGH-PRESSURE FUEL PUMP

CLAIM OF PRIORITY

The present application claims priority from Japanese application serial no. 2006-197558 filed on Jul. 20, 2006, the contents of which are hereby incorporated by reference into this application.

TECHNICAL FIELD

The present invention relates to a fuel supply pump in an internal combustion engine for an automobile, and in particular to a high-pressure fuel pump which supplies a high-pressure fuel to a fuel injection valve in an in-cylinder fuel injection type internal combustion engine.

BACKGROUND ON THE INVENTION

A high-pressure fuel pump to which the present invention is applicable, has a plunger slidably fits to a cylinder and a pressurizing chamber whose volumetric capacity can be variable by a reciprocation of the plunger. The plunger pressurizes a fuel led into the pressurizing chamber through an inlet valve device, and discharges the fuel through an outlet valve device.

As a high-pressure pump of this type, the following types are known. One type is a high-pressure pump wherein a pressurizing chamber is formed in a pump body and the head of a cylinder protrudes into the pressurizing chamber (for example, a high-pressure pump described in the International Publication WO 02/055881 pamphlet). Another type is a high-pressure pump wherein a pressurizing chamber is formed in a cylinder (for example, a high-pressure pump described in Japanese Unexamined Patent Publication No. 2001-295770, 2003-49743, or the like).

Such high-pressure fuel pumps trend toward a higher pressure and a larger capacity of a fuel. In such a trend, this sort of high-pressure fuel pump is reciprocated, for example, constantly at a high speed of about 100 hertz (Hz) (at present, such a high speed occurs only in a high speed rotation region wherein an engine rotates at 6,000 rpm). In this condition, a lubricant (liquid film) formed in a gap between a cylinder and a plunger, which is formed by a part of the pressurized fuel from the pressurizing chamber, may become to be prone to deficient due to the heat generated by the slide of the plunger on a sled face of the cylinder. It may become a cause of that the sliding face (outer surface) of the plunger and the sled face (inner surface) of the cylinder are seized up or jammed even by the generation of a trifling amount of stress acting in the radial direction.

As a method for solving a similar problem in a similar field, known is a method of: forming a hole in the center of a piston corresponding to a plunger from the tip thereof in the axial direction; further forming a plurality of holes in the radial direction through which the hole in the axial direction communicates with the outer surface of the piston; and leading a part of the pressurized fuel from the piston side to the gap between the piston and a cylinder through the communicating holes (Japanese Unexamined Patent Publication No. H11 (1999)-22493).

In the case of such a conventional configuration, in the state of compression in the process where the piston protrudes into the pressurizing chamber, a fuel in the pressurizing chamber is pressurized and supplied to the gap between the piston and the cylinder through the communicating pass (namely the hole formed in the plunger). However, positions of openings of the communicating pass on the slide face (on the outer surface) of the piston side always move in the axial direction in response to reciprocation of the piston, hence unstable force is loaded on the slide face in the radial direction, and jamming may rather increase.

Meanwhile, in a suction stroke state where the piston increases the capacity of the pressurizing chamber, the pressure in the pressurizing chamber lowers and hence the fuel at the gap between the piston and the cylinder may be extracted on the side of the pressurizing chamber through the communicating pass. On this occasion, the extraction state may continue while the positions of the openings of the communicating pass on the outer surface side of the piston move in the axial direction in response to the movement of the piston, hence the fuel at the gap between the piston and the cylinder is likely to be extracted. Thereby, lubricity may not improve less than expected, although such a complex communicating pass is provided.

Further, a diameter of the plunger in a high-pressure fuel pump to which the present invention is applied is as small as 10 millimeters (mm), thereby the strength of the plunger itself lowers if holes are formed in the plunger by a known technology, buckling tends to occur by the stress in the radial direction, and the original functions of the plunger may not be exercised.

SUMMARY OF THE INVENTION

In view of the above situation, an object of the present invention is to provide this kind of high-pressure fuel pump having a high lubricity and toughness.

In the present invention, a communicating pass for leading apart of the pressurized fuel comprises a hole or a groove formed in the cylinder, and the hole or groove communicates between a pressurized fuel area and a gap between the cylinder and the plunger, in order to attain the above object.

DETAILED DESCRIPTION OF THE INVENTION

Some embodiments of the present invention are hereinafter explained in detail in reference to drawings.

Embodiment 1

The first embodiment of the present invention is explained in reference to FIGS. 1 to 6.

Figure 1:
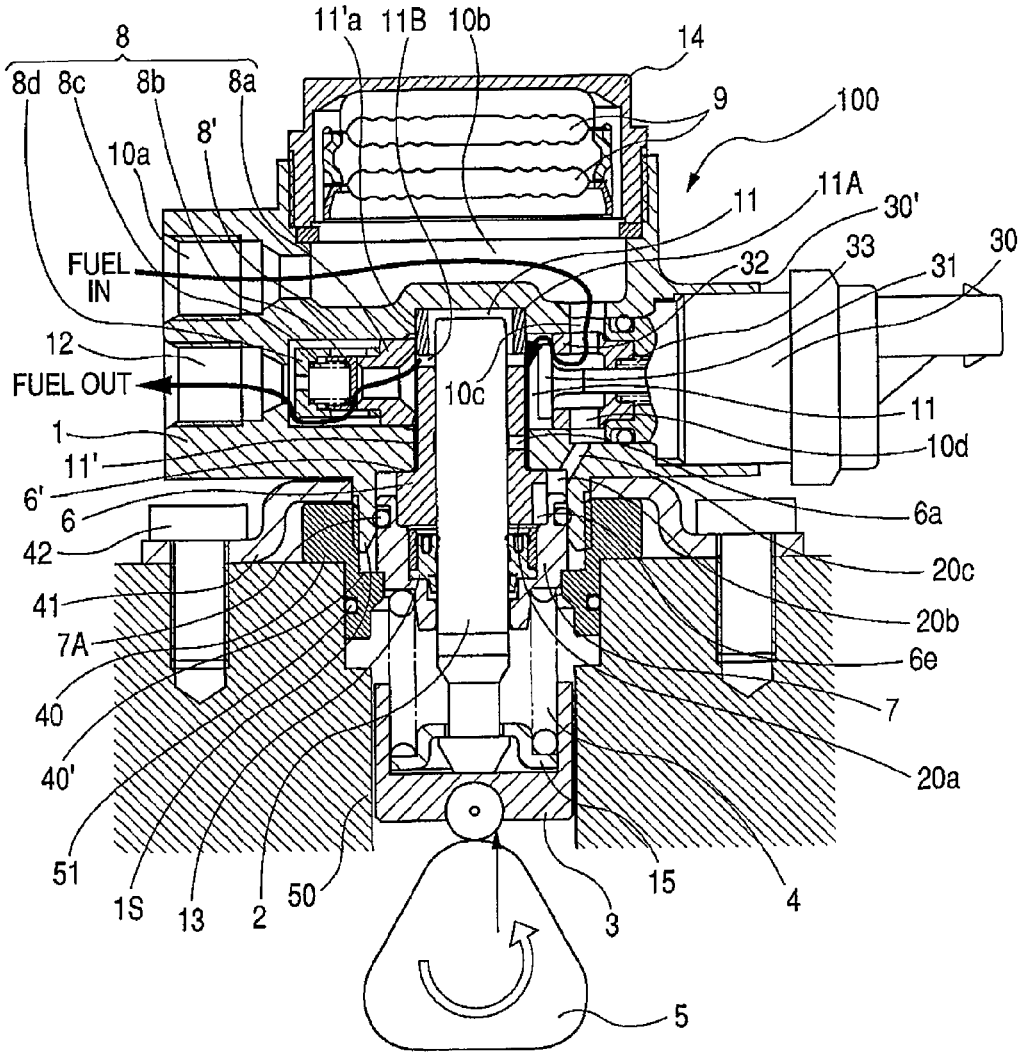
FIG. 1 is a vertical sectional view of a high-pressure fuel pump according to the present invention.
Figure 6:
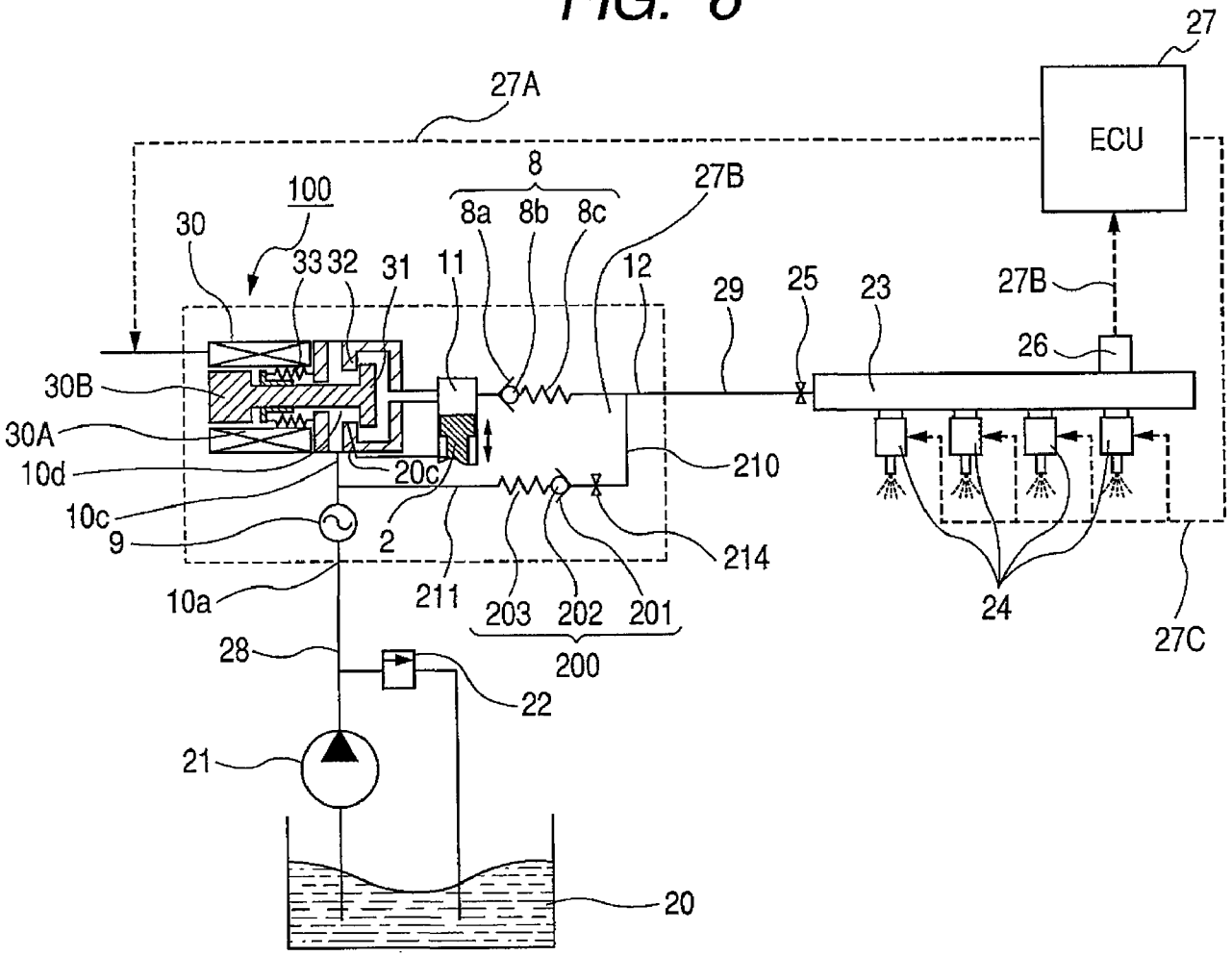
FIG. 6 is an explanatory view showing a fuel system to which the present pump is applied.

FIG. 1 is a vertical sectional view of a high-pressure fuel pump according to the present invention. FIG. 6 is a view showing a fuel feeding system using the high-pressure fuel pump shown in FIG. 1.

A fuel sucked up from a fuel tank 20 with a low-pressure feed pump 21 is fed into a fuel inlet 10*a* of a high-pressure fuel pump 100 through a suction pipe 28. A pressure regulator 22 controls a fluid pressure in the suction pipe 28 to a constant level and controls the amount of the fuel supplied to the high-pressure pump 100. Here, it is also possible to directly control the flow rate of the fuel discharged from the low-pressure pump 21 and control the fluid pressure in place of the installment of the pressure regulator 22.

The fuel fed in the fuel inlet 10*a* is taken in a low-pressurizing chamber 10*d* through a damper room 14 (described later) in which metal dampers 9 are placed and a suction channel 10*c*.

A pump body 1 is provided with a pressurizing chamber 11. In the embodiment 1, the pressurizing chamber 11 is formed separating from a cylinder 6. The pressurizing chamber 11 is formed by a metal ring 11A fixed over the cylinder 6, an annular gap 11B between the cylinder 6 and the metal ring 11A, a pump body 1 covering an upper end of the metal ring 11A, and a space between the annular gap 11B and an inlet valve device 30.

An inlet valve 31 and a valve seat 32 are provided between the pressurizing chamber 11 and the low-pressurizing chamber 10*d* to cooperatively control taking in the fuel.

A spring 33 exerts its force to the inlet valve 31 so as to attract the inlet valve 31 to the valve seat 32, thereby the inlet valve can close when an electromagnetic valve drive device 30A is in "off". When the device 30A is in "on", the inlet valve 31 is driven so as to leave from the valve seat 32 against the attraction force of the spring 33, thereby the inlet valve can open. An electromagnetically driven inlet valve device 30 comprises the inlet valve 31, the seat 32, the spring 33, and the electromagnetic drive system 30A.

When a plunger 2 goes down by the rotation of a cam 5 (shown in FIG. 1) while the electromagnetically driven inlet valve device 30 opens the inlet valve 31, the fuel is sucked into the pressurizing chamber 11. After that, when the cam 5 further rotates, the plunger 2 turns to going up, and the electromagnetically driven inlet valve device 30 closes the inlet valve 31 at a specific timing after the plunger 2 turns to going upward. Thereby, the sucked fuel into the pump 100 is pressurized to a high-pressure with the plunger 2 in the pressurizing chamber 11. The pressurized fuel is fed from a fuel outlet 12 to a common rail 23 via a restrictor 25 passing through a high-pressure pipe 29.

The common rail 23A is provided with a pressure sensor 26, and an output from the pressure sensor 26 is monitored by an engine control unit 27 (herein after abbreviated as "ECU") to detect a pressure change in the common rail. An injector 24 attached to each cylinder of an internal-combustion engine is connected to the common rail 23 and directly injects the fuel of an amount required by each cylinder into the cylinder by a drive signal from the ECU 27.

An electric power line 27A is used for feeding a drive current to the electromagnetic valve drive device 30A. A signal line 27B is used for transferring a detection signal from the pressure sensor 26 to the ECU. An electric power line 27C is used for feeding a drive current to fuel injector 24.

The high-pressure fuel pump 100 of the present embodiment shown in FIG. 1 includes all the component parts surrounded by the broken line 100 in FIG. 6.

As shown in FIG. 1, the pump body 1 is provided with a vertical hole 11' with a recess 11'*a*. The recess 11'*a* is provided the metal ring 11A used for the pressurizing chamber 11. A cylinder 6 for guiding the reciprocation of the plunger 2 is fixed to the pump body 1 so that a part of the cylinder 6 is inserted into the vertical hole 11'. The plunger 2 is slidably installed in the cylinder 6 to form a pressurizing mechanism. A metallic contact part between an outer surface of the cylinder 6 and a part of the pump body 1 serves as a metallic seal for the fuel in the interior. As a result, the fuel in the pressurizing chamber can be pressurized to about 20 megapascals (MPa) or, if necessary, more than that by cooperation of the reciprocating plunger 2 in the pressurizing chamber 11, the aforementioned electromagnetically driven inlet valve device 30, and a outlet valve mechanism 8 with a valve seat 8*a*, an outlet valve 8*b*, and a return spring 8*c*.

A metal damper 9 is installed in the fuel channel on the low-pressure side and has the function of reducing fuel pulsation occurred in the fuel channel on the low-pressure side.

The fuel pulsation in the fuel channel on the low-pressure side, which will be described later in detail, occurs as follows. That is, apart of the fuel once taken in the pressurizing chamber 11 is returned toward the low-pressurizing chamber side by making the plunger 2 go up while the inlet valve 31 is kept open, in order to control the amount of an discharged fuel. At that time, a back-flow (also called overflow) toward the low-pressurizing chamber 10*d* occurs in the fuel channel on the low-pressure side.

According to the above-mentioned operation, the electromagnetically driven inlet valve device 30 has also a function of controlling the discharged fuel amount.

Hereinafter, the operation of the high-pressure fuel pump 100 is detailed as follows.

(Suction Stroke)

In a state of that the electromagnetically driven inlet valve device 30 is in "off", the inlet valve 31 is attracted to the valve seat 32 with the force of the spring 33, so that the inlet valve 31 is in a closing state. The outlet valve 8*b* also is in a closing state.

In this state, when the cam 5 rotates and the plunger 2 is going down by the force of a spring 4, namely in a state of the plunger being pulled into the cylinder 6, a difference pressure between the pressure of a low-pressurizing chamber 10*d* (1.5 to 2 atmosphere, namely 0.15 to 0.2 MPa, in terms of the feed pressure of the feed pump 21) and the pressure of the pressurizing chamber 11 side changes, so that the pressure of the pressurizing chamber side becomes smaller than that of the low-pressurizing chamber. Accordingly, the difference pressure force acting in a direction of opening the inlet valve 31 becomes larger than the force of the spring 33, so that the inlet valve 31 leaves from the valve seat 32 against the force of spring 33 and opens. That is, the inlet valve 31 is so designed as to be able to overcome the pre-load of the spring 33 by the valve opening force produced by the fluid pressure difference and open. Thereby the low-pressure fuel is led into the pressurizing chamber 11. The state is called a suction stroke.

When the cam 5 further rotates and an electromagnetic actuator 30A of the electromagnetically driven inlet valve device 30 is energized before the plunger 2 turns to going up, an electromagnetic plunger 30B of the device 30 is operated to keep an open state of the inlet valve 31 while further compressing the spring 33.

(Backflow Stroke)

Consequently, in this state, the inlet valve 31 is remained in an open state even when the cam 5 further rotates and the plunger 2 goes down; thereby a part of the fuel within the pressurizing chamber 11 backflows to the low-pressurizing chamber 10*d* and the suction channel 10*c* side, namely the fuel is returned there. This process is called a backflow stroke (or an overflow stroke).

In this state, a pressure pulsation occurs in the suction channel 10*c* due to the backflow. The pressure pulsation can be absorbed and reduced by expansion and contraction of the metal damper 9 for absorption of the pressure pulsation.

When the energization for the electromagnetic actuator 30A is cut off, the electromagnetic plunger 30B quickly closes the inlet valve 31 by the return force of the spring 33 and a fluid force exerting to the inlet valve 31. From this point in time, the fuel compression stroke starts as the plunger 2 further goes up. In this state, when the fuel pressure of the fuel becomes higher than the force in the closing direction of the spring 8*c* for the outlet valve 8*b*, the outlet valve 8*b* opens, and the pressurized fuel is discharged by the outlet 12 of the pump 100. This process is called a discharge stroke. Resultantly, a compression stroke of the plunger comprises the return stroke and the ejection stroke.

Thus, the discharge amount of the high-pressure fuel can be controlled by controlling a stop timing of the energization for the electromagnetically driven inlet valve device 30. When the stop timing is advanced, a proportion of the back-flow stroke in the compression stroke (plunger going up stroke) decreases and a proportion of the discharge stroke increases. That is, the amount of the fuel returned to the low-pressurizing chamber 10*d* decreases and the amount of the pressurized and discharged fuel increases. In contrast, when the stop timing is delayed, the proportion of the back-flow stroke in the compression stroke (plunger going down stroke) increases and the proportion of the discharge stroke decreases. That is, the amount of the fuel returned to the low-pressurizing chamber 10*d* increases and the amount of the pressurized and discharged fuel decreases. The stop timing of the energization, namely the discharged fuel amount, is determined and controlled by the ECU 27 in accordance with to an operation state of an engine.

A cylindrical channel 10*b* as a part of the suction channel 10 is formed outside the vertical hole 11' forming the pressurizing chamber 11 in the pump body 1 and the channel 10*b* has a circle opening. The circle opening is sealed with a damper cover 14 and the metal damper 9 is installed in the interior.

Thus, the fuel of the low-pressure side is fed the pressurizing chamber 11 through the fuel inlet 10*a* formed in the pump body 1, the cylindrical channel 10*b* provided with the metal damper 9, and the channel 10*c* communicating with the low-pressurizing chamber 10*d*.

In the pump body 1, a horizontal mounting hole 30' for mounting the electromagnetically driven inlet valve device 30 is formed together with the vertical hole 11' for the pressurizing chamber 11. The electromagnetically driven inlet valve device 30 is inserted into the mounting hole 30' in the manner of interposing a sealing member and fixed. The inlet valve 31 is installed at the inlet portion of the pressurizing chamber 11.

Additionally, another horizontal mounting hole 8' for mounting the outlet valve device 8 is also formed together with the vertical hole 11' for the pressurizing chamber 11, in the pump body 1. Before installing the devices 8 and 30, the above-mentioned two horizontal mounting holes (8', 30') for them and the vertical hole 11' are communicated to each other in series. The horizontal mounting hole 8' for the outlet valve device 8 is designed so as to have a smaller diameter than the diameter of the horizontal mounting hole 30' for inlet valve device 30, so that the outlet valve device 8 can be inserted from the side of the horizontal mounting 30' for the inlet valve device 30.

The outlet valve device 8 is press-fitted and fixed to the horizontal mounting hole 8', after that, a metal ring 11A is press-fitted and fixed into the top recess 11'*a* of the vertical hole 11' for the pressurizing chamber 11. A part of the metal ring 11A protrudes from the recess 11'*a* and is adjacent to one end of the outlet valve device 8, so that the protruding part of the metal ring 11A functions as a stopper for the outlet valve device 8. Additionally, the metal ring 11A functions of reducing a capacity of the pressurizing chamber 11 and thus improving the compression efficiency are secured.

The cylinder 6 is inserted into the vertical hole 11' of the pump body 1 so that a part of the cylinder 6 may protrude into the vertical hole 11' for the pressurizing chamber 11. An annular seal face formed around the outer surface of the cylinder 6 contacts with on a seal face formed around an opening of the vertical hole 11'.

More specifically, a seal ring 7A is attached to the outer surface of a cylinder holder 7, thereafter a seal device 13 is installed in the interior of the cylinder holder 7. The seal device has an annular gasoline seal and an annular oil seal slidably touching the surface of the plunger 2 which are placed at a prescribed interval in the axial direction. The bottom end of the cylinder 6 is received to a stepped portion of an inside of the cylinder holder 7.

The inner diameter of the cylinder holder 7 is set such that the stepped portion of the inside of the cylinder holder 7 can contact to the bottom end of the cylinder. A part of the plunger 2 is inserted into the cylinder 6 and the seal system 13. The cylinder holder 7 is integrated together with the plunger 2, the cylinder 6, and the seal system 13 in the pump body 1. The cylinder holder 7 is installed in an inner circumference of a cylindrical sleeve 1S of the pump body 1.

The outer surface of the cylindrical sleeve 1S is provided with a male thread. A tightening holder 40 for tightening and holding the cylinder holder 7 has a female thread in a part of an inner surface of the holder 40. The tightening holder 40 is attached to the cylindrical sleeve 1S through the joint of those threads. The tightening holder 40 has a stepped portion 40' for supporting the cylinder holder 7. The tightening holder 40 is attached to the cylindrical sleeve 1S by screwing with the above-mentioned treads, thereby the cylinder holder 7 is pressed to a bottom end of the cylinder 6. The cylinder 6 has a stepped portion 6' in a lower part thereof, and the stepped portion 6' has a seal face for contacting to the bottom end of the pump body 1. With attachment of the tightening holder 40 to the cylindrical sleeve 1S, the cylinder holder 7 presses the seal face of the stepped portion 6' of the cylinder 6 to the seal face at the bottom end of the pump body 1, and thereby the pressurizing chamber 11 is sealed.

A metal fixture 41 for fixing the pump to the engine is tightened between the tightening holder 40 and the pump body 1. By so doing, a sealing work for the metal seal between the cylinder 6 and the pump body 1, a fixing work for the cylinder holder 7, and a fixing work of the tightening holder 40 are done simultaneously.

The high-pressure fuel pump 100 is attached to an engine by attaching screw 2. A spring 4 is interposed between the bottom end of the cylinder holder 7 and a spring bearing 15 attached to a lower part of the plunger 2. Thereby, the pressing force of the spring 4 is given to the cylinder holder 7. The spring bearing 15 is covered with a lifter 3. Successively, by using the outer circumference of the lifter 3 as a guide, the bottom end of the plunger 2 is inserted into a mounting hole 50 of an engine head, so that the lifter 3 touches the cam 5. An outer surface of the tightening holder 40 and an inner surface of the mounting hole 50 of the engine head are sealed with a seal ring 51 attached to the outer surface of the tightening holder 40. Finally, the metal fixture 41 is secured to the engine with screws 42, so that the tightening holder 40 is pushed and fixed to the surface of the engine.

The plunger 2 reciprocates in the pressurizing chamber 11, sucks a fuel into the pressurizing chamber 11, backflows (overflows) a part of the sucked fuel from the pressurizing chamber 11 to the low-pressurizing chamber 10*d* as aforementioned, after that, pressurizes the fuel in the pressurizing chamber, and discharges the pressurized fuel, that is, exercises the function of a pump.

The fuel leaking from the pressurizing chamber 11 through a gap between the plunger 2 and the cylinder 6 (called a blow-by fuel) reaches a fuel reservoir 20*a* formed between the seal device 13 and the bottom end of the cylinder 6. The fuel reservoir 20*a* communicates with the low-pressurizing chamber 10*d* through a vertical groove 6*e* provided on the outer surface of the cylinder 6, an annular space 20*b* around the outer surface of a part of the cylinder 6, and a return channel 20*c* formed by penetrating the pump body 1. The annular space 20*b* is surrounded by the outer surface of the cylinder 6, the inner surface of the pump body 1, the cylinder holder 7, and the seal ring 7A. By a arrangement of vertical groove 6*e*, annular space 20*b*, and return channel 20*c*, it is possible to prevent the pressure in the fuel reservoir 20*a* from abnormally increasing due to the blow-by fuel, and to prevent the seal device from being adversely affected.

Further, the seal device 13, which installed around the outer surface of the lower portion end of the plunger 2, prevents the fuel from leaking outside. In addition, the seal device 13 prevents a lubricating oil, which lubricate contact portions between the cam 5 and the lifter 3 and between the lifter 3 and the plunger 2, from flowing into the fuel channels including the pressurizing chamber 11 and the low-pressurizing chamber 10*d*.

Further, a relief valve device 200, that prevents the common rail 23 from having an abnormally high-pressure, is installed in the pump body 1 though it is not shown in FIG. 1. The relief valve device 200 comprises a relief valve seat 201, a relief valve 202, a relief holder 203, and a relief spring 204. The relief device 200 is disposed in the relief channels 210 and 211 being branched from the high-pressure channel between a downstream portion from the outlet valve device 8 and the outlet 12 and reaching the low-pressure fuel channel 10*c*. Just before the pressure of the high-pressure fuel channel including the common rail 23 reaches abnormal high, the pressure is transmitted to the relief valve 201, the relief valve 201 leaves from the relief valve seat 201 against the force of the relief spring 204, the abnormal high-pressure is released to the inlet channel, and thereby the high-pressure pipe 29 and the common rail 23 are prevented from being damaged. Here, since it is configured so that the abnormal high-pressure may be transmitted through the restrictor 214, the relief valve 202 does not open with a high-pressure state for a very short period of time that occurs at the time of discharge. Thereby malfunction is avoided.

Figure 2:
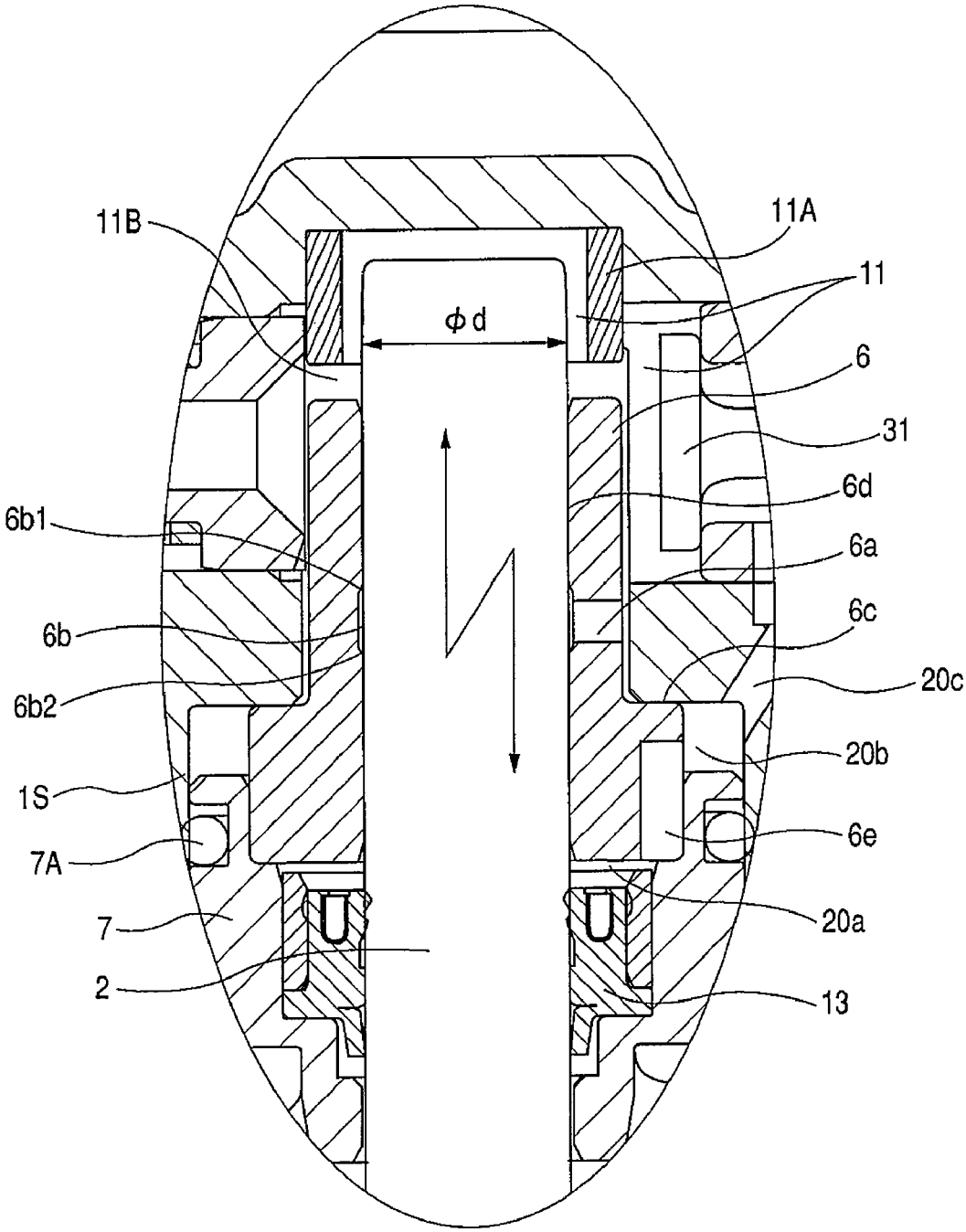
FIG. 2 is an enlarged vertical sectional view of the high-pressure fuel pump of FIG. 1.
Figure 3:
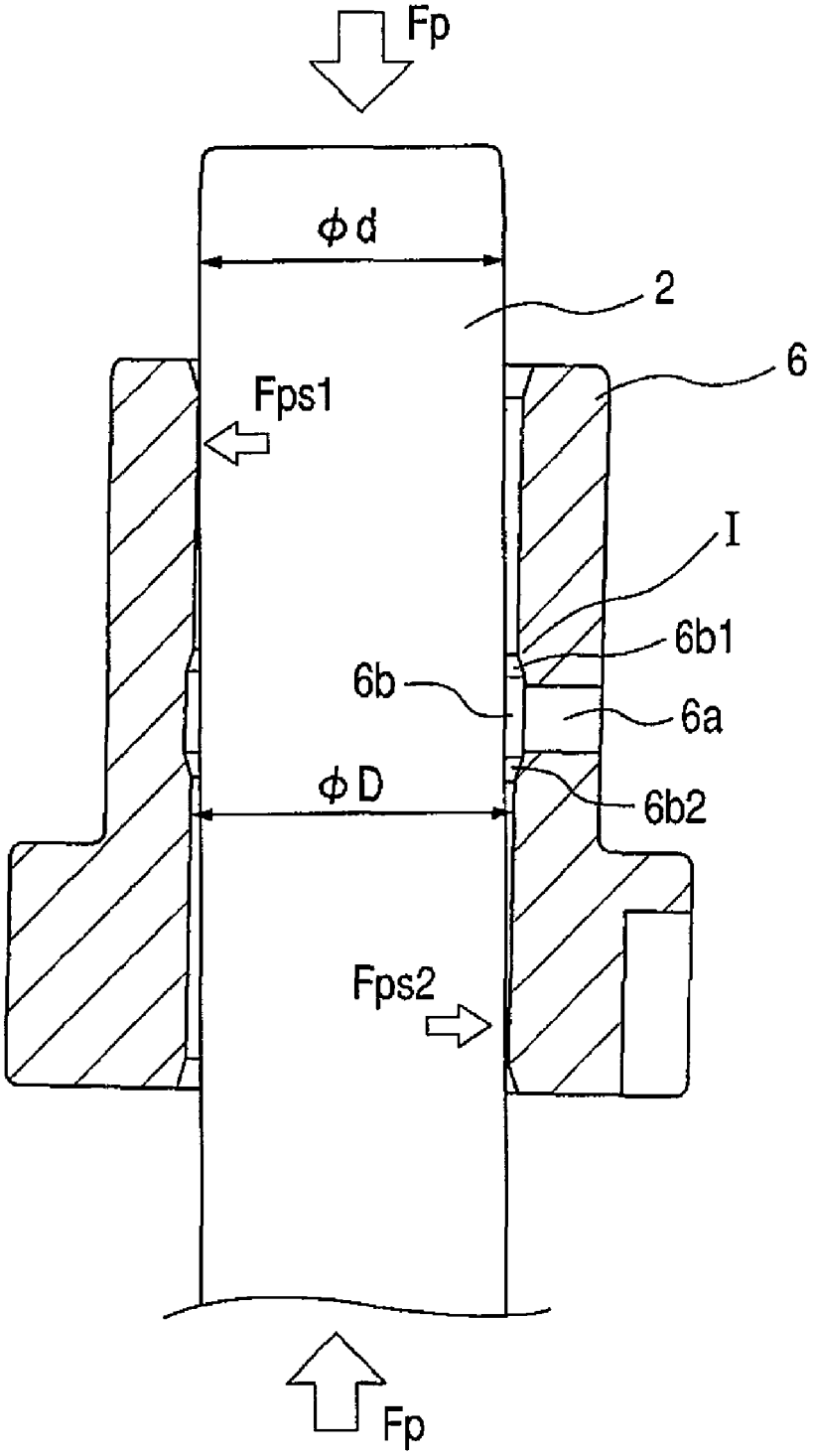
FIG. 3 is an explanatory view schematically showing the action of force at a part of the high-pressure fuel pump.
Figure 4:
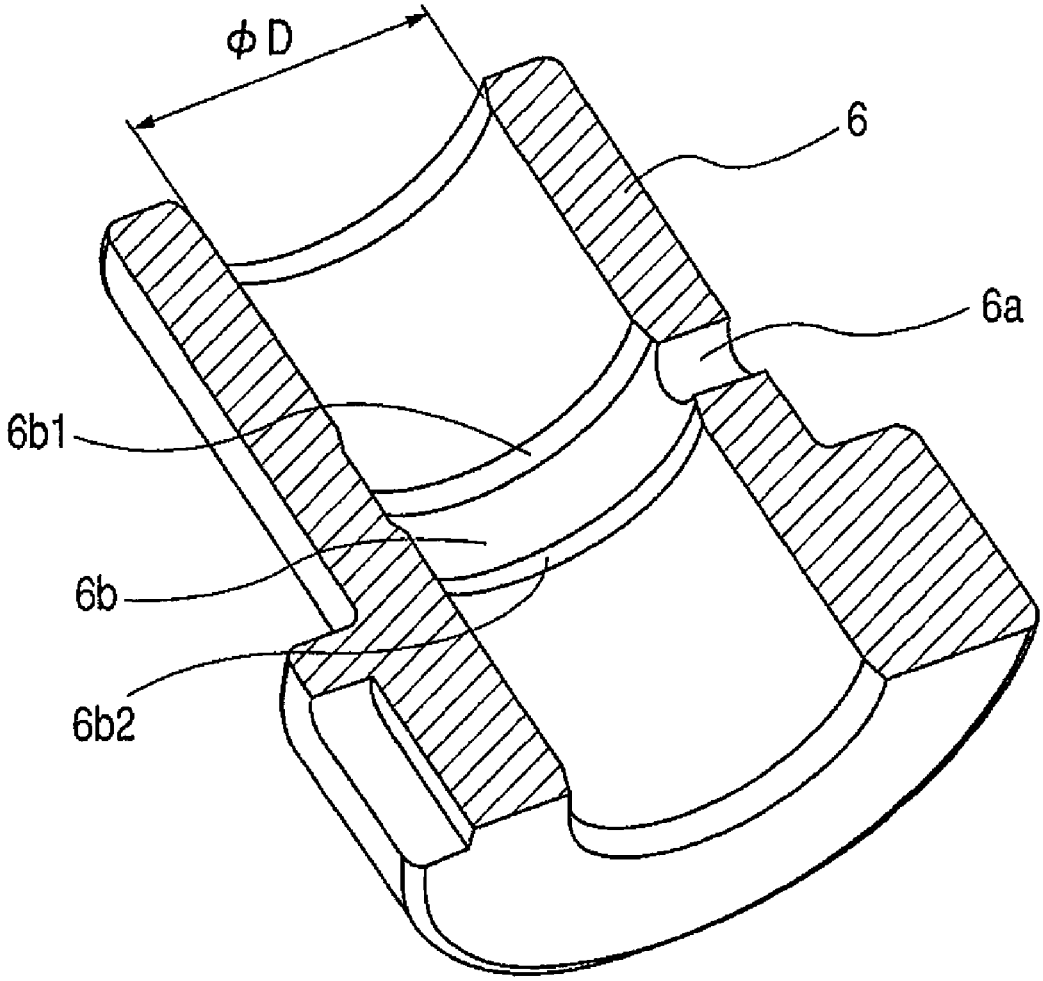
FIG. 4 is a sectional perspective view of a cylinder of the high-pressure fuel pump.

The operations and problems of the pressurizing system are hereunder explained in more detail additionally in reference to FIGS. 2 to 4. FIG. 2 is an enlarged view showing a pressurizing system portion and, FIG. 3 is a view being enlarged intentionally for making the gap between the plunger 2 and the cylinder 6 easy to understand and also showing the action of force. FIG. 4 is a perspective view showing the cylinder 6 cut into half on a plane including the center axis thereof for making the structure of the cylinder 6 easy to understand.

When the energization for the electromagnetic actuator 30A is cut off during the going up stroke of the plunger 2 and the inlet valve 31 is closed, the interior of the pressurizing chamber 11 enters the pressurizing stroke of the fuel. When the pressurizing stroke starts, the fuel in the pressurizing chamber 11 is compressed and pressurized rapidly. When the interior of the pressurizing chamber 11 is pressurized to a high-pressure, a force Fp acts as compression reaction force in the axial direction on the plunger 2 in the manner of being interposed between the pressurizing chamber 11 and the lifter 3. The plunger 2 of the outer diameter ϕd has a diameter gap (ϕD−ϕd) of, for example, about 10 μm to the cylinder 6 of the inner diameter ϕD and hence the plunger 2 is inclined against the cylinder 6 to the extent proportional to the diameter gap. The inclination of the plunger 2 produces the transverse (horizontal) force components Fps1 and Fps2 of the compression reaction force. The transverse force components Fps1 and Fps2 of the plunger 2 are loaded on the inner face of the cylinder 6 and the outer face of the plunger 2, and thus the slide bearing stress between the plunger 2 and the cylinder 6 increases.

When the fuel pressure is set at a higher pressure, the compression reaction force Fp increases, namely the transverse force components Fps1 and Fps2 also increase, and the slide bearing stress increases. The problem caused by the increase of the slide bearing stress is that the liquid film the gap between the plunger (sliding surface) and the cylinder (sled surface) cannot be kept and the slidability of the plunger deteriorates. Further, by the increase of the slide bearing stress, frictional heat caused by a relative movement of the plunger 2 and the cylinder 6 increases, and a fuel having a low boiling temperature and a high volatility is likely to be vaporized at the slide portion. The vaporization of the fuel can be a factor of liquid loss and hence accelerates the deterioration of the slidability.

In order to solve the above problem in the deterioration of the slidability, the present example is configured so as to protrude a part of the cylinder 6 into the pressurizing chamber 11 and bring a part of the outer surface of the cylinder 6 into contact with the fuel. The structure is designed such that the outer surface of the cylinder 6, whose temperature is prone to rise due to the frictional heat, may be easily cooled by the fuel. The fuel is conveyed from a fuel tank 20 to the present high-pressure fuel pump 100 and thereafter discharged toward injectors 24. Therefore, even if the fuel is warmed by the present high-pressure fuel pump 100, the warmed fuel is discharged from the present high-pressure fuel pump 100, successively the fuel stored in the fuel tank 20 at a low temperature comparable to an external temperature flows from the low-pressurizing chamber 10*d* into the present high-pressure fuel pump 100, and hence the cylinder 6 is cooled. Further, since the fuel around the outer surface of the cylinder 6 is also agitated by the reciprocation of the plunger 2, the heat transfer coefficient improves and the cylinder 6 is cooled.

The structure of protruding the cylinder 6 into the pressurizing chamber 11 not only improves cooling capability as described above but also leads to the downsizing of the present high-pressure fuel pump 100 to the extent proportional to the protrusion in the vertical direction in FIG. 1. The adoption of the following configurations contributes to the downsizing of the high-pressure fuel pump in the axial direction of the plunger 2. That is, the pressurizing chamber and the low-pressurizing chamber are sealed from each other at an edge end face 6*c* (the seal face at the stepped portion described earlier) formed by increasing the outer diameter of a part of the lower portion of the cylinder 6; and a part of the cylinder 6 protrudes into the pressurizing chamber 11, and the upper part of the cylinder 6 is set at a height substantially identical to the height of the electromagnetically driven inlet valve device 30 and the outlet valve device 8 in the axial direction.

Further, as a structure solving the problem in the deterioration of the slidability, the following structure is adopted as shown in FIG. 2. That is, the cylinder 6 is provided with a transverse hole 6*a* for communicating between the outside and the inside of the cylinder 6; wherein the outside of the cylinder also communicates with the pressurizing chamber 11, and the inner surface of the cylinder 6 is provided with an annular groove 6*b* communicating to the transverse hole 6*a*. According to such an arrangement, a high pressure and a part of the high-pressure fuel in the pressurizing chamber is led to the gap between the plunger 2 and the cylinder 6 through the transverse hole 6*a* and annular groove 6*b*.

Since the high-pressure of the pressurized fuel and a part of thereof are led to the gap between the plunger 2 and the cylinder 6, the transverse hole 6*a* as the communicating pass makes the pressure of the gap equal to that of the pressurized fuel area such as the pressurizing chamber, and can lead a part of the pressurized fuel to the gap. Thereby, the slide bearing stress can be reduced and ensure the lubricating effect of a liquid film on the gap between the outer surface (sliding face) of the plunger 2 and the inner surface (sled face) of the cylinder 6.

In addition, the lubricating liquid film can be formed by the fuel being sent from the fuel tank 20 at the suction stroke, wherein the fuel has a temperature close to an external temperature. Accordingly, the lubricating liquid can have a cooling effect and can actively contact with the sliding face of the plunger and the sled face of the cylinder where frictional heats are generated, and thereby can improve the cooling effect.

Further, as shown in FIGS. 3 and 4, a wall of the annular groove 6*b* is provided with a taper portion 6*b*1, wherein the taper portion 6*b*1 is formed at one end side of the annular groove 6*b* in an axial direction of the cylinder 6 and the one end side is closer side to the pressurizing chamber 11 than another end side. A depth of the taper portion 6*b*1 gradually decreases toward the pressurizing chamber 11. The taper 6*b*1 serves as a dynamic pressure bearing in the pressurizing stroke of the plunger 2, so that it acts advantageously for the increase of pressure in the gap between the plunger 2 and the cylinder 6, namely acts for the formation of the liquid film, by the wedge effect. Furthermore, since an intersection portion I (refer to FIG. 3) between a tip of taper 6*b*1 and the sled surface (cylindrical inner surface) of the cylinder 6 adjacent to the taper tip, forms an obtuse angle, it is possible to realize an arrangement that burrs and the like are hardly produced at the intersection I (the edge portion) between the taper 6*b*1 and the sled surface of the cylinder face from the viewpoint of production. By the same reason on the production, a taper 6*b*2 is also formed at the annular groove on the side of the low-pressurizing chamber 20*a* but this taper may be omitted.

Figure 5:
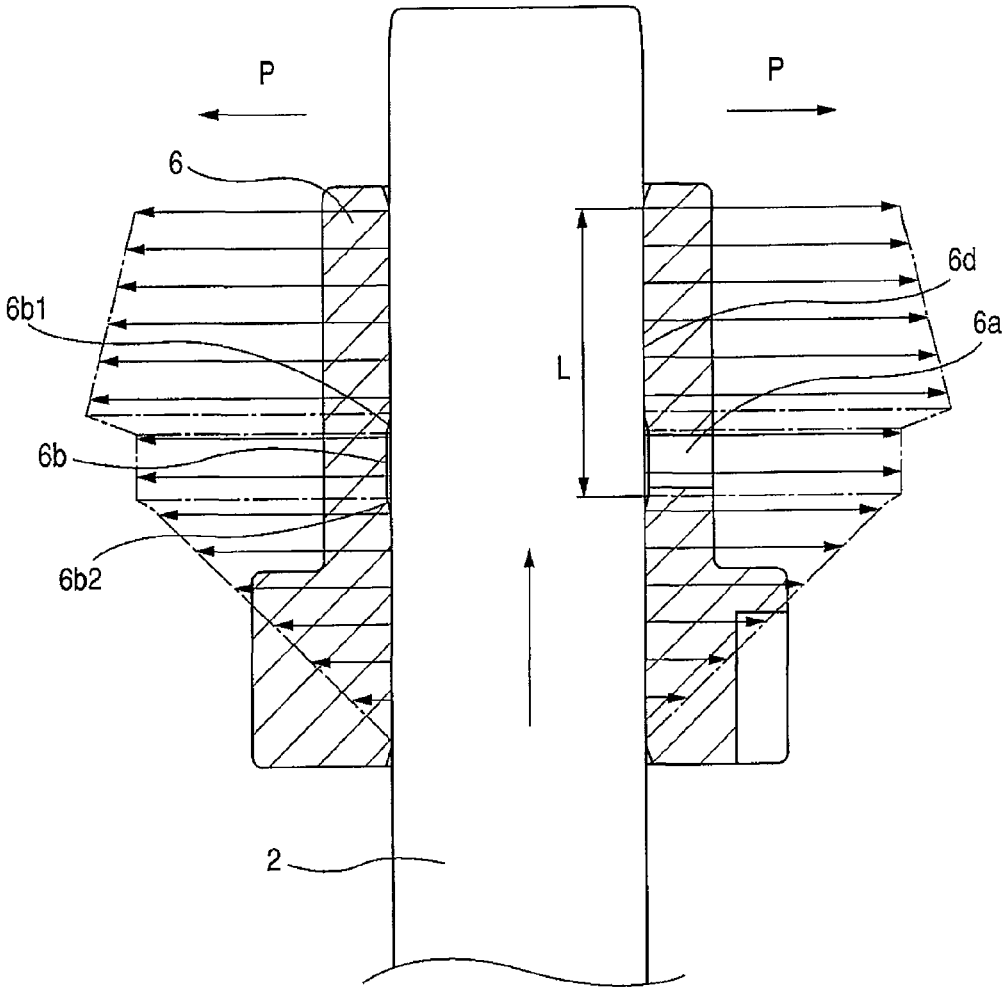
FIG. 5 is a view showing the distribution of pressure generated between a plunger and the cylinder of the high-pressure fuel pump.

FIG. 5 is a view showing the distribution of pressure generated between the plunger 2 and the cylinder 6. In the stroke of pressurizing the fuel, when the pressure of the pressurizing chamber 11 increases, the high-pressure fuel is intrudes on the gap 6*d* between the inner surface (sliding surface) of plunger 2 and the outer surface (sled surface) of the cylinder 6. At the same time, the pressure in the pressurizing chamber 11 propagates also on the outer surface side of the cylinder 6, passes through the transverse hole 6*a*, and is led to the annular groove 6*b* on the inner surface side of the cylinder. The high-pressure fuel led to the annular groove 6*b* also intrudes on the gap 6*d* between the plunger 2 and the cylinder 6. When the high-pressure fuel intrudes on the gap 6*d*, the plunger 2 is in the state of the going up (ascending) stroke in the figure and hence pressure additionally increases due to the wedge effect at the taper 6*b*1. It is estimated that the wedge effect further appears particularly in a high speed operation where the slidability tends to deteriorate.

As described above, a high-pressure P exerts on the gap 6*d* between the plunger 2 and the cylinder 6 ranging from the groove 6*b* on the cylinder inner circumference side to the pressurizing chamber 11 (distance L shown in the figure). In other words, on the inner face of the cylinder 6, the gap (sliding and sled area) 6*d* between the plunger 2 and the cylinder 6 ranging from the groove 6*b* on the cylinder inner circumference side to the side of the pressurizing chamber 11 functions as a slide bearing with a high-pressure liquid film having the axial length L, and good slidability is maintained as a result.

The transverse hole 6*a* that leads the pressurized fluid to the slide face between the plunger 2 and the cylinder 6 is configured so as to protrude a part of the cylinder 6 into the pressurizing chamber 11 and raise the pressure of a part of the outer circumference of the cylinder 6 at the time of pressurizing. Thereby, by simply forming one transverse hole in the cylinder 6, moreover at an arbitrary position in the circumferential direction, the structure wherein the high-pressure fluid is led to the gap between the plunger 2 and the cylinder 6 can be realized and that is very advantageous for production. Here, it goes without saying that a plurality of transverse holes may be formed.

When the annular groove 6*b* is not formed, the structure should be so designed as to form a taper by chamfering one end of the transverse hole 6*a* on the cylinder inner surface side, and obtain the same wedge effect as the above-mentioned taper 6*b*1.

By the configuration wherein a part of the cylinder 6 protrudes into the pressurizing chamber 11 and the pressurized fluid is led to the gap between the plunger 2 and the cylinder 6, the pressure on the outer surface side of the cylinder 6 is identical to the pressure on the inner surface side thereof, therefore a deformation of the cylinder 6 caused by the pressure is suppressed, and the wall thickness of cylinder 6 can be reduced. Thus the configuration has the advantage of contributing to the downsizing of the pump.

The increase of the pressure on the slide face 6*d* between the plunger 2 and the cylinder 6 has the advantage that the fuel forming the liquid film on the gap 6*d* (the sliding face on the plunger and the sled face of the cylinder) is unlikely to be vaporized. For example, a fuel which vaporizes at 130° C. at a pressure of 1 MPa does not vaporize up to the level of about 230° C. when the pressure is 10 MPa. That is, the gap 6*d* between the plunger 2 and the cylinder 6 generates heat due to frictional heat but, by leading a pressurized fluid sufficiently on the slide face, the fuel hardly vaporizes, in other words, the loss of an liquid film caused by vaporization is easily avoided, and thus thermal sticking hardly occurs.

Further, by applying a high-pressure fluid to the slide face 6*d* between the cylinder 6 and the plunger 2, the weight of the fluid existing on the slide face 6*d* increases in comparison with the case of not applying a high-pressure fluid. The increase of the fluid weight leads to the increase of the thermal capacity of the fluid existing on the slide face 6*d*, plays the role of preventing frictional heat from being generated, and is advantageous for the prevention of thermal sticking.

Further, in the present embodiment, since the fuel reservoir 20*a* is connected to the low-pressurizing chamber 10*d* through the return channel 20*c*, a high-pressure or low-pressure cold fuel circulates also in the fuel reservoir 20*a* by forming the transverse hole 6*a*. As a result, an lubricating liquid film is sufficiently formed also on the gap 6*d* between the transverse hole 6*a* and the fuel reservoir 20*a* and slidability improves. Furthermore, since the fuel reservoir 20*a* is connected to the low-pressurizing chamber 10*d* through the return channel 20*c*, there is not the chance of increasing the amount of the fuel accumulating in the fuel reservoir 20*a* or increasing the pressure of the fuel reservoir 20*a*. As a result, there is not the fear that a high-pressure is loaded on a seal system and the seal system is damaged.

Embodiment 2

Here, a configuration of merely increasing the diameter gap (ϕD−ϕd) between the plunger 2 and the cylinder 6, leading a high-pressure fuel coming from the pressurizing chamber 11 to the gap between outer surface of the plunger 2 and the inner face of the cylinder 6 from the top end of the cylinder 6, and thus increasing the amount of the high-pressure liquid may be adopted. The configuration has the fear of increasing the leaning of the plunger 2 and increasing the amount of leakage from the pressurizing chamber 11 to the fuel reservoir 20*a*, and hence can be applied to a device that does not have such fear.

Embodiment 3

Further, it is also effective either to partially form a gap (1) larger than the gap (2) for the guide of the plunger or to form a straight vertical groove or a spiral groove at any part of either surface where the outer surface of the plunger 2 and the inner surface of the cylinder 6 face to each other as a communicating pass leading the pressurized fluid to the slide face. The configuration is more effective since a circulation channel is formed by combining the configuration with the configuration of forming a transverse hole 6*a* in the cylinder 6 or the configuration of further forming an annular groove 6*b* in the cylinder 6, those two configurations being explained earlier.

In the present embodiment, the diameter gap for plunger guide is at most about 10 μm and hence the inclination of the plunger 2 never increases. Further, the seal lengths of the plunger 2 and the cylinder 6 in the high-pressure and the low pressure can be substantially identical in comparison with the case of forming the transverse hole 6*a* and hence the amount of leakage of the fuel from the pressurizing chamber 11 to the fuel reservoir 20*a* is nearly the same as that in Embodiment 1.

Embodiment 4

Furthermore, the present invention is applicable also to a high-pressure fuel pump of a type where a pressurizing chamber is formed in a cylinder (for example, those described in Japanese Unexamined Patent Publications Nos. 2001-295770 and 2003-49743). This type of the high-pressure fuel pump is configured such that: an upper end of the cylinder is sealed with an inlet valve device; the high-pressurizing chamber is formed within the cylinder; an outlet valve device is installed adjacent to the outer surface of the cylinder; and a pressurized fuel channel is provided between the outlet valve device and the pressurizing chamber. In the case of high-pressure pump of this type, one end of the communicating pass opens on an inner wall of the pressurized fuel channel and the other end thereof opens on an inner wall of the cylinder.

For example, the communicating pass is formed by an oblique hole bored in the wall of the cylinder. It is possible to makes a pressure of the gap between the cylinder and the plunger equal to that of the pressurized fuel area (the pressured fuel channel), and to lead a part of the pressurized fuel to the gap, without the installment of such a complicated channel. In this embodiment, an annular groove equivalent to the annular groove 6*b* of the embodiment 1 may be provided on the inner surface of the cylinder such that one end of the oblique hole as the communicating pass opens the inner surface of the annular groove. Thereby, the same effect as the aforementioned embodiments 1 can be obtained. In the case of this type, the fuel is sucked into the cylinder and hence the effect that the sucked cold fuel cools the sled face from the interior of the cylinder is also expected. Further, since the pressurizing chamber comprises the cylinder itself that is made of a metal of a high hardness such as a tool steel, the thickness of the cylinder itself can be increased. Therefore, an advantage thereof is that there is not the possibility that the cylinder itself may be deformed even when a temperature rises or a stress is loaded in the transverse direction.

Embodiment 5

Further in another embodiment, it is also possible to be configured so as to form a porous surface layer on the slide face between a plunger and a cylinder located on the pressurizing chamber side and hold the fuel in the porous concavities. The configuration can be realized by combining the configurations of Embodiments 1 to 4, and makes it possible to obtain a more effective lubricity.

According to Examples 1 to 5 above, it is possible to provide a high-pressure fuel pump that does not cause thermal sticking or galling at a slide portion even when a slender plunger slidably fitting to a cylinder is driven at a high speed.

Further, since a hole is not formed in a plunger, the possibility that the plunger is bent by a stress in the radial direction is the same as a conventional case. Rather reliability can be improved to the extent of the elimination of the possibility that galling and thermal sticking are caused between the plunger and a cylinder by the improvement of lubricity at a slide portion by a fuel.

According to the present invention configured as stated above, it is possible to obtain a high-pressure fuel pump that is durable and can stably lead a part of the pressurized fuel to the gap between a cylinder and a plunger even when the plunger is driven at a high speed.

The present invention can be applied to not only a high-pressure fuel pump in a cylinder injection type internal combustion engine but also a water pump, an oil hydraulic pump, a pump for a diesel vehicle, and the like, as long as the pump is a plunger type pump to pump a fluid.

What is claimed is:

1. A high-pressure fuel pump comprising:

a plunger which slidably fits to a cylinder and reciprocates for pressurizing and discharging a fuel taken in a pressurizing chamber;

an inlet valve device for taking in a fuel into the pressurizing chamber;

an outlet valve device for discharging the pressurized fuel from the pressurizing chamber; and a communicating pass which comprises a hole or a groove formed in the cylinder, and communicates between a pressurized fuel area in the pressurizing chamber and a gap between the cylinder and the plunger;

wherein the high-pressure fuel pump is configured so that a head side portion of the cylinder protrudes into the pressurizing chamber, and thereby an outer surface of the head side portion of the cylinder is located so as to contact with the pressurized fuel in the pressurizing chamber; and wherein one end of the communicating pass opens at the pressurized fuel area on an outer surface of the cylinder and the other end of the communicating pass opens on an inner surface of the cylinder where the plunger slidably reciprocates.

2. A high-pressure fuel pump according to claim 1, wherein the communicating pass comprises a hole boring in a wall of the cylinder, and wherein the inner surface of the cylinder is provided with an annular groove, and one end of the hole as the communicating pass opens in the annular groove.

3. A high-pressure fuel pump according to claim 1, wherein the communicating pass comprises a hole boring in a wall of the cylinder, one end of the hole opens on the inner surface of the cylinder having a sliding area for the plunger, the other end opens on the outer surface of the cylinder so as to communicate to the pressurizing chamber, and the one end of the hole as the communicating pass has a taper widening toward an inside of the cylinder.

4. A high-pressure fuel pump according to claim 2, wherein at least an upper end of the annular groove has a taper formed in a circumferential direction of the inner surface of the cylinder, and wherein a depth of the taper portion gradually decreases toward the pressurizing chamber.

5. A high-pressure fuel pump according to claim 1, wherein one end of the cylinder, which is on the side opposite to the pressuring chamber, is provided with a sealing device for sealing one end of the gap between the cylinder and the plunger, the sealing device is covered with a sealed space, and the sealed space communicates with a low-pressurizing chamber on an upstream side of an inlet valve of the inlet valve device.

6. A high-pressure fuel pump according to claim 1, wherein the outer surface of the cylinder has a seal portion which seals the pressurizing chamber by tightly making contact with a part of an outer surface of a pump body of the high-pressure fuel pump, and a transverse hole as the communicating pass is bored in a wall of the cylinder at the pressurizing chamber side with respect to the seal portion so as to communicate between the outer wall surface of the cylinder and the inner surface of the cylinder.

7. A high-pressure fuel pump comprising:

a pressurizing chamber formed within a pump body;

a cylinder fixed to the pump body;

a metallic seal portion formed by a metallic contact part between a part of an outer surface of the cylinder and a part of the pump body;

a plunger which slidably reciprocates on an inner surface of the cylinder to pressurize fuel taken in the pressurizing chamber and discharge pressurized fuel from the pressurizing chamber;

an inlet valve device for taking the fuel into the pressurizing chamber; and an outlet valve device for discharging the pressurized fuel from the pressurizing chamber;

wherein a head side portion of the cylinder protrudes into the pressurizing chamber so that the outer surface of a part of the cylinder is located so as to contact the pressurized fuel in the pressurizing chamber; and wherein the cylinder is provided with a transverse hole that, at one end, opens into the pressurizing chamber at the outer surface of the cylinder and that, at its other end, opens on the inner surface of the cylinder where the plunger slidably reciprocates.

8. A high-pressure fuel pump according to claim 7, wherein the inner surface of the cylinder on which the plunger slidably reciprocates is provided with an annular groove, and said other end of the transverse hole opens to the annular groove.

9. A high-pressure fuel pump according to claim 7, wherein an opening of said other end of the transverse hole has a taper that widens toward an inside of the cylinder.

10. A high-pressure fuel pump according to claim 8, wherein ends of the annular groove are tapered such that the annular groove widens toward an inside of the cylinder.

11. A high-pressure fuel pump according to claim 7, wherein one end of the plunger, which is on a side opposite to the pressuring chamber with respect to the cylinder, is provided with a plunger sealing device for sealing around the plunger to provide a sealed space around the plunger, and the sealed space communicates with a low-pressurizing chamber on an upstream side of an inlet valve of the inlet valve device.

12. A high-pressure fuel pump according to claim 11, further comprising a cylinder holder, which holds the plunger sealing device and a part of the cylinder on the side opposite to the pressurizing chamber, wherein the cylinder holder is fixed to the pump body to provide for installation of the plunger sealing device and the cylinder to the pump body.

13. A high-pressure fuel pump according to claim 7, wherein a part of a fuel channel on a low-pressure side of the fuel pump is provided outside the pressurizing chamber so as to be covered with a damper cover, a damper chamber for a damper which absorbs a fuel pressure pulsation is formed by the damper cover, and the fuel on the low-pressure side is guided to the inlet valve side through the damper chamber.

14. A high-pressure fuel pump according to claim 7, wherein, in the cylinder, a length from the metallic seal portion to one end at the pressurizing chamber side is longer than a length from the metallic seal portion to the other end opposite to the pressurizing chamber side.

15. A high-pressure fuel pump according to claim 7, wherein the one end of the plunger protrudes into the pressurizing chamber through the cylinder.

16. A high-pressure fuel pump according to claim 8, wherein the annular groove is located at a middle point of the cylinder.

17. A high-pressure fuel pump according to claim 7, wherein the outlet valve is installed from a pressurizing chamber side into the pump body.

18. A high-pressure fuel pump according to claim 7, wherein the pump body is provided with the outlet valve by installation from a pressurizing chamber side in the pump body, and a horizontal mounting hole for the outlet valve device is designed to have a smaller diameter than the diameter of a horizontal mounting hole for the inlet valve device.

* * * * *